US009586237B2

(12) United States Patent
Calvet et al.

(10) Patent No.: US 9,586,237 B2
(45) Date of Patent: Mar. 7, 2017

(54) DEVICE AND METHOD FOR CLEANING A WIRE

(75) Inventors: Marc Calvet, Clermont-Ferrand (FR); Marc Chavarot, Clermont-Ferrand (FR)

(73) Assignees: COMPAGNIE GENERALE DES ETABLISSEMENTS MICHELIN, Clemont-Ferrand (FR); Michelin Recherche et Technique S.A., Granges-Paccot (CH)

( * ) Notice: Subject to any disclaimer, the term of this patent is extended or adjusted under 35 U.S.C. 154(b) by 1054 days.

(21) Appl. No.: 13/703,547

(22) PCT Filed: May 31, 2011

(86) PCT No.: PCT/EP2011/058913

§ 371 (c)(1),
(2), (4) Date: Apr. 16, 2013

(87) PCT Pub. No.: WO2011/154284

PCT Pub. Date: Dec. 15, 2011

(65) Prior Publication Data

US 2013/0206169 A1 Aug. 15, 2013

(30) Foreign Application Priority Data

Jun. 11, 2010 (FR) ..... 10 53969

(51) Int. Cl.

| | |
|---|---|
| ***B66B 7/12*** | (2006.01) |
| ***B08B 1/00*** | (2006.01) |
| ***B08B 1/04*** | (2006.01) |
| ***B08B 1/02*** | (2006.01) |
| ***B21C 43/04*** | (2006.01) |

(52) U.S. Cl.
CPC ..... *B08B 1/002* (2013.01); *B08B 1/02* (2013.01); *B08B 1/04* (2013.01); *B21C 43/04* (2013.01)

(58) Field of Classification Search
CPC ..... B08B 1/02; B08B 1/04; B21C 43/04
USPC ..... 15/88, 88.3, 256.6, 104.04
See application file for complete search history.

(56) References Cited

U.S. PATENT DOCUMENTS

| | | | | | |
|---|---|---|---|---|---|
| 613,707 | A * | 11/1898 | McKeown | B08B 1/04 | 15/4 |
| 2,887,702 | A * | 5/1959 | Freitag | B08B 1/008 | 15/23 |
| 3,445,285 | A * | 5/1969 | Nast | B23K 35/40 | 134/15 |

(Continued)

FOREIGN PATENT DOCUMENTS

| | | | | |
|---|---|---|---|---|
| EP | 1 570 925 | 9/2005 | | |
| FR | 2 364 705 | 4/1978 | | |
| TW | EP 1570925 A1 * | 9/2005 | ..... | B08B 1/02 |

*Primary Examiner* — Michael Jennings
(74) *Attorney, Agent, or Firm* — Cozen O'Connor

(57) ABSTRACT

Device for scrubbing a metal wire, including means for feeding and running the wire (F), at least two pairs of rotary brushes (21, 22) having a radius r, the axes of which are substantially mutually parallel and perpendicular to the direction in which the wire runs, application means, suitable for contacting the brushes with the wire via the circumferences thereof in order to exert a given pressure on the wire (F) while the device is operating, and means (31, 32) of adjusting the tension of the wire are provided directly upstream and downstream of the assembly of brushes.

7 Claims, 2 Drawing Sheets

(56) References Cited

U.S. PATENT DOCUMENTS

| | | | | | |
|---|---|---|---|---|---|
| 3,945,077 | A * | 3/1976 | Elsbery | B08B 1/02 | 15/100 |
| 4,286,449 | A * | 9/1981 | Spreafico | B21C 43/04 | 15/88 |
| 4,422,208 | A * | 12/1983 | Rohrbaugh | D07B 7/12 | 15/236.09 |
| 4,570,285 | A * | 2/1986 | Skelton | B63B 21/14 | 15/104.04 |
| 4,982,473 | A * | 1/1991 | Farris | B08B 1/02 | 118/DIG. 21 |
| 5,036,563 | A * | 8/1991 | Liebing | B66B 7/1284 | 15/181 |
| 5,782,987 | A * | 7/1998 | Furman | B08B 5/02 | 134/15 |
| 6,142,076 | A * | 11/2000 | Corrado | B08B 1/02 | 101/423 |
| 2002/0133891 | A1* | 9/2002 | Lisciani | B21C 43/04 | 15/88 |
| 2007/0044267 | A1* | 3/2007 | Connolly | B66B 7/1284 | 15/256.6 |

* cited by examiner

DEVICE AND METHOD FOR CLEANING A WIRE

RELATED APPLICATIONS

This is a U.S. National Phase Application under 35 USC 371 of International Application PCT/EP2011/058913 filed on May 31, 2011.

This application claims the priority of French application no. 10/53969 filed Jun. 11, 2010, the entire content which is hereby incorporated by reference.

Field of Invention

The invention concerns the field of manufacturing metal wires designed to provide tire reinforcers. In general terms, these wires are used to constitute reinforcing plies made from lengths of wire coated with a rubber mixture, mutually parallel and describing a given angle with the longitudinal direction of the ply.

These wires can be single wires or assemblies of wires obtained by twisting single metal wires.

BACKGROUND OF THE INVENTION

In order to improve their strength, some of these wires, of the type formed by assembly, have the particularity of incorporating a core coated in rubber. However, the manufacture of these particular wires can cause unevenness on the surface of the wire linked with overspill of the rubber used to sheath the wire core on the outer layers of the said wire.

This unevenness can cause anomalies when manufacturing the reinforcing plies by locally changing the pitch between two wires and impairing the quality of the rubber bridges that are intended to be produced between the wires to link them together.

It therefore proves necessary in certain cases to complete the manufacturing process of wires having a core sheathed in rubber with a cleaning stage designed to remove all traces of unwanted rubber.

SUMMARY OF THE INVENTION

One object of the invention is to propose a device and a method designed to accomplish this additional stage.

The device for scrubbing a metal wire according to one aspect of the invention includes:

means for feeding and running the wire, at least two pairs of rotary brushes having a radius r, the axes of which are substantially mutually parallel and perpendicular to the direction in which the wire runs, application means, suitable for contacting the brushes with the wire via the circumferences thereof in order to exert a given pressure on the wire while the device is operating.

This device is characterised in that means of adjusting the tension of the wire are provided directly upstream and downstream of the assembly of brushes.

In this way, it is possible to exert a certain pressure on the wire with the brushes in order to enhance the scrubbing efficiency and to enable elimination of the rubber residues present on the surface of the wire, without the force of application of the brushes on the wire deforming the wire due to the tension exerted on it.

DETAILED DESCRIPTION OF THE DRAWINGS

Figure 1:
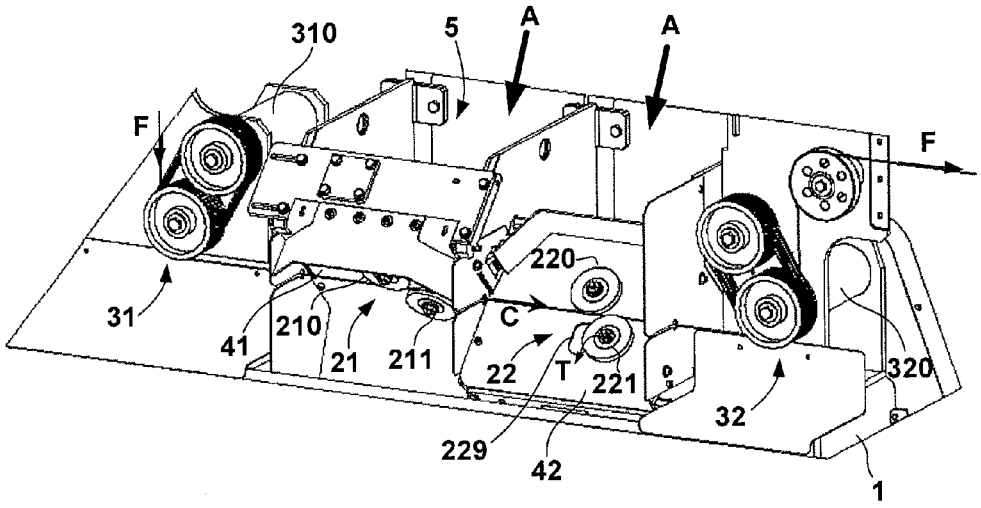
FIG. 1 shows a perspective view of the device according to an embodiment of the invention.

The device illustrated in FIG. 1 includes a chassis 1 on which the units designed to scrub the wires are installed.

The wire F runs from an upstream unwinding means (not illustrated) to a downstream receiving means (not illustrated). However, it is quite possible to insert an equivalent device at the end of the line of a wire rubber-coating and assembling unit, or even upstream of a calendering process or a process for producing a rubber-coated wire.

The means for feeding the wire F into the device are composed of the transport rollers 310 and 320 and of the unwinding or feed means situated upstream, and the receiving means situated downstream, each incorporating its own drive motor.

In the specific case of the device that is the subject of this description, the assembly of brushes is composed of two pairs of rotary brushes 21 and 22. These pairs of brushes are installed on the trajectory of the wire, which runs in a rectilinear manner between two transport rollers 31 and 32. The brushes (210, 211, 220, 221) have a substantially circular shape having a radius r.

The axes of rotation of a pair of brushes are mutually parallel and substantially perpendicular to the direction C in which the wire runs. The axes of the two pairs of brushes are also mutually perpendicular.

Figure 5:
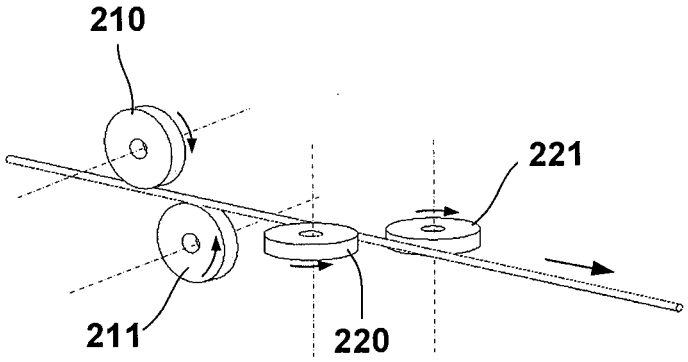

When it is planned to have more than two pairs of brushes, the axes are then arranged such that the directions of the axes between them describe equal angles in order to reach the entire circumference of the wire to be scrubbed, as illustrated in FIG. 5, where the axes of the two pairs of brushes are mutually perpendicular and parallel to a plane perpendicular to the direction C in which the wire runs in the scrubbing device.

Figure 3:
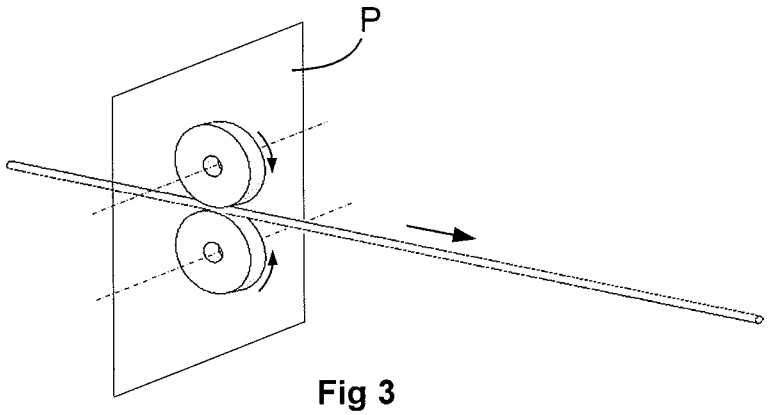
FIGS. 3 to 5 show different arrangement variants of the brushes.
Figure 4:
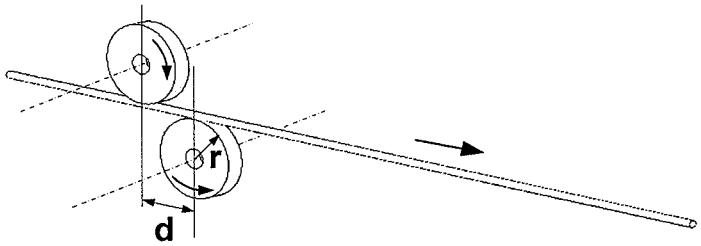

The axes of the brushes can be arranged in order to be situated in a plane P perpendicular to the direction C in which the wire runs as illustrated in FIG. 3, or, as illustrated in FIG. 4, they can be offset by a given length d.

Each pair of brushes is mounted on a plate (41, 42), which supports the drive motor assembly for the brushes (not illustrated). At least one brush of the pair includes application means suitable for contacting the brushes with the wire.

Figure 2:
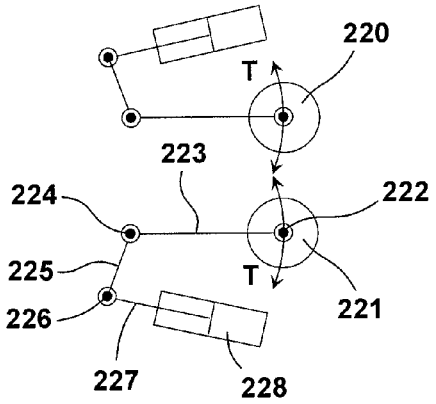
FIG. 2 shows a diagrammatic view of the operation of the application means.

In the present case, each of the brush axes is mounted mobile such that it runs in an opening 229 made in the plate 42. The trajectory of the brush is made along the direction, substantially circular, of the arrow T, as illustrated in FIG. 2. As an example, the axis 222 of the brush 221 is supported by an arm 223 pivoting around an axis 224 mounted on the plate and connected to an actuator, itself composed of an arm 225 connected by an axis 226 to the piston 227 of a jack 228. The axis of the brush remains perpendicular to the plane of the plate 42 during this movement. This mechanism is located below the plate to isolate it from the rubber particles torn from the wire surface during the scrubbing operation. Identical mechanisms are provided to drive the movement of the brushes 220, 210 and 211.

When the device is operating, the brushes 220 and 221 come to press on the wire, which is then placed simultaneously in contact with the circumferences of the two brushes of the pair, which then exert a given application pressure thereon. The application force of the brushes on the wire can usefully lie between 1 N and 8 N.

The brushes (210, 211, 220, 221) are driven in rotation by motors (not visible) installed under the plates 41, 42. The brushes of a given pair have identical speeds of rotation, but in opposite directions (see FIGS. 3, 4 and 5), in order to allow the bristles of the brushes to intermingle if necessary. It is also contrived so that the tangential speed of the brushes at the point of contact with the wire lies in the opposite direction to the direction in which the wire runs in the device.

The speed of rotation of the brushes can usefully lie between 3000 r.p.m. and 6000 r.p.m. It will be noted here that the higher the speed of rotation of the brushes, the better the wire scrubbing. Furthermore, at these speeds, advantage is taken of the effects of the centrifugal force to force the evacuation of the rubber particles torn from the surface of the wire.

To this effect, in order to be protected against projections of particles, the device can be placed in an enclosed space 5 in which air A is made to circulate by means of a forced ventilation means in order to ensure that the said rubber particles are evacuated into a suitable dust collecting means.

It is then important to ensure that the wire remains as rectilinear as possible so that the brushes work efficiently. To this effect, it is envisaged that means for adjusting the tension are provided upstream 31 and downstream 32 of the assembly of brushes, and which have the aim of maintaining a given and calibrated tension along the entire path of the wire along the pairs of brushes. These means are composed of an upstream transport roller 31 and a downstream transport roller 32, around each of which the wire is wound several times.

Each transport roller is driven in rotation by a motor 310, 320 of the asynchronous type. The motor of the transport roller situated downstream of the brush assembly has a speed of rotation dictated by the feed rate of the wire in the process. The speed of the upstream motor 310 is therefore made subject to the speed of the downstream motor 320, and a braking torque is imposed on the upstream motor 310 in order to place the wire under tension between the two transport rollers 31 and 32.

Good scrubbing results are obtained by imposing on the wire a tension of between 5 daN and 20 daN, determined in particular according to the diameter of the wire to be scrubbed.

Thus, in a general manner, the greater the tension in the wire, the better the possibility of applying the brushes with a high pressure, and the better the quality of the scrubbing performed will be.

The wire running speed in the device can vary between 50 m/min and 600 m/min, or even more. It will be noted that the running speed of the wire in the device can easily itself be made subject to the wire running speed in an upstream or downstream process without adversely affecting the quality of the scrubbing performed.

The bristles of the brushes are composed of radial metal wires arranged on the hub of the brush. It can prove to be prudent to choose brush bristles in a material whose hardness is suitable, in order to avoid damaging the coatings on the wire to be scrubbed.

The invention claimed is:

1. A device for scrubbing a metal wire, comprising:

a means for feeding and running the wire;

at least two pairs of circular brushes, each circular brush being mounted for rotation about an axis, the axes of circular brushes being substantially mutually parallel and perpendicular to a direction in which the wire runs;

an application means, suitable for causing a circumference of the rotating circular brushes to contact the wire under pressure while the device is operating; and a tension adjusting means for adjusting tension of the wire as the wire passes between the two pairs of circular brushes comprising at least two transport rollers driven in rotation by motors associated with a means for controlling the torque and speed of the at least two transport rollers, one transport roller being positioned upstream of the two pairs of circular brushes, and one transport roller being positioned downstream of the two pairs of circular brushes.

2. The device according to claim 1, wherein the wire runs in a rectilinear manner between the at least two transport rollers.

3. The device according to claim 1, wherein the circular brushes of a pair of circular brushes are capable of rotating at an identical speed and in opposite directions.

4. The device according to claim 1, wherein the axes of the circular brushes of each pair of circular brushes are situated in a plane perpendicular to the direction in which the wire runs.

5. The device according to claim 1, wherein the axes of the circular brushes of each pair of circular brushes are offset in relation to each other relative to a plane perpendicular to the direction in which the wire runs by a given length.

6. The device according to claim 1, wherein a tangential speed of the circular brushes of a pair of circular brushes at a point of contact of the circumference of the circular brushes with the wire is in a direction opposite to the direction in which the wire runs.

7. The device according to claim 1, further comprising:

an enclosure in which the at least two pairs of circular brushes are positioned; and a means for circulating forced air in the enclosure.

* * * * *